United States Patent [19]

Peytavin

[11] Patent Number: 4,541,262

[45] Date of Patent: Sep. 17, 1985

[54] PROCESS FOR COLD ROLLING OF TUBES BY MEANS OF A PILGER MILL AND DEVICE FOR USING THE PROCESS

[75] Inventor: Pierre Peytavin, Neuilly-sur-Seine, France

[73] Assignee: Vallourec S.A., Paris, France

[21] Appl. No.: 515,575

[22] Filed: Jul. 20, 1983

[30] Foreign Application Priority Data

Jul. 21, 1982 [FR] France ..... 82 13035

[51] Int. Cl.[4] ..... B21D 7/02

[52] U.S. Cl. ..... 72/214; 72/250

[58] Field of Search ..... 72/214, 250, 251

[56] References Cited

U.S. PATENT DOCUMENTS 4,005,595 2/1977 Gerretz et al. ..... 72/250

4,019,394 4/1977 Peytavin ..... 74/27

4,154,079 5/1979 Peytavin ..... 72/214

*Primary Examiner*—Lowell A. Larson

*Assistant Examiner*—Jorji M. Griffin

*Attorney, Agent, or Firm*—Oblon, Fisher, Spivak, McClelland & Maier

[57] ABSTRACT

The process and the device which are the object of the invention relate to the cold rolling of tubes by means of a Pilger mill. The tube blank is made to advance near each of the upstream and downstream dead centers reached by the roll stand during its forward and return cyclical movement and backward movement of the rear part of the blank is made possible during a return pass of the roll stand. This process makes possible a doubling of production without changing the operating rate of the roll stand.

15 Claims, 10 Drawing Figures

PROCESS FOR COLD ROLLING OF TUBES BY MEANS OF A PILGER MILL AND DEVICE FOR USING THE PROCESS

BACKGROUND OF THE INVENTION

1. Field of the Invention

This invention relates to a cold rolling process for the manufacture of tubes by means of a Pilger mill. This mill comprises in a known way grooved rolls mounted in a mobile roll stand which makes a back and forth movement along the axis of the tube blank which is periodically advanced, the rolls being made to rotate by a known means. A mandrel is placed in the axis of the blank which is thus rolled between the rolls and the mandrel.

2. Description of the Prior Art

Modern Pilger mills of this type operate at high rolling rates which require moving the tube blank to be rolled for relatively short periods, at the very exact moments when the stand arrives at the end of its travel and when the rolls release the blank.

French Pat. No. 1,602,013 describes a Pilger mill having devices which impart periodic forward movements to the blank along its axis and rotation movements around this same axis when the rolls are at dead center and release the blank, at the end of their alternating back and forth travel.

The rotation movements are imparted to the blank by tube clamps placed on both sides of the roll stand. The periodic and discontinuous forward movements are imparted to the blank by an articulated pusher, mounted on a carriage which supports the rear of the blank and advances continuously in the direction of the stand.

As described in patent FR No. 1,602,013, this pusher, in the shape of a lever, is articulated around an axis. A cam controls the forward axial movement of the blank while imparting to the pusher a periodic rocking movement synchronized with the back and forth movement of the roll stand, when the stand is near dead center at the end of travel of one of its forward or return movements and when the rolls release the blank.

For clarity in the description, hereafter the input side of the blank to be rolled in the roll stand is called the upstream side and the output side of the tube from the stand after reduction of its section by rolling between the rolls is called the downstream side. The upstream-downstream movement of the stand and the rolls is called the forward pass and the downstream-upstream movement is called the return pass along the axis of the blank.

The rolling, according to the technique described in the patent FR No. 1,602,013, is usually done only during the forward pass, or from upstream to downstream from the rolls, the grooves of the rolls being designed to allow the free passage of the blank to be rolled for a short moment near the upstream dead center.

Thus, according to this use of the rolling mill, the rolls effectively work the metal by deforming it only during the forward pass of the stand. During the return pass, the rolls make only another pass over a product already rolled, without performing any deformation work.

FR No. 2,442,674 teaches, however, that it is advantageous to have the blank advance and turn only when it is released from the grip of the two rolls, when they are at the end of travel near the downstream dead center. Moreover, this patent teaches that the deformation of the blank is distributed between the forward and return passes of the rolls although the blank cannot be advanced near the upstream dead center.

FR No. 2,463,646 teaches that, to obtain the highest possible output, the blank is made to advance and turn near both the upstream and downstream dead centers of the forward and return movement of the rolls, the upstream advance being different from the downstream advance. This patent teaches that the maximum advance of the blank can, according to the circumstances, be done either upstream or downstream. The document, however, does not teach the criteria on which the definition of the upstream advance and the downstream advance must be based. Nor does it teach the means for making these advances, and further it does not teach the means that make it possible to assure, under satisfactory conditions, rolling during the return pass.

Moreover, given the heavy weights to be moved cyclically and which comprise, not only the roll stand but also the blank and its pusher, it is essential to have control means that exhibit at the same time a minimum of inertia, a high operating speed and great precision. Where there are none of these various means, it does not appear that cold rolling processes using a Pilger mill having a double advance of the blank has been hitherto developed.

Therefore, the possibility of developing a cold rolling process for tubes by means of a Pilger mill has been studied in which, to obtain maximum efficiency, the deformation work of the tube blank would be distributed suitably and, preferably equally between the forward pass and the return pass of the roll stand. The possibility of moving the blank cyclically downstream, near the upstream and downstream dead centers of the forward and return movement of the roll stand with speed and precision, while making possible its elongation upstream during the rolling during the return pass of the roll stand was also studied. Finally, a study was made to define the relation preferentially to be achieved between the advances that should be performed near the upstream dead center and downstream dead center to obtain during the rolling, during the forward pass more or less the same deformation work as during the rolling during the return pass.

The possibility was also studied of making a simple device that could be used on a Pilger mill, making it possible to make different advances near the upstream and downstream dead centers whose values are in a predetermined ratio and can be precisely reproduced.

SUMMARY OF THE INVENTION

The process for cold rolling of tubes, which is the object of this invention, relates to a Pilger mill having a roll stand driven in a cyclical forward and return movement in which the tube blank is made to advance near each of the upstream and downstream dead centers, making possible the backward movement of the rear part of the blank during the rolling performed during the return pass of the roll stand.

Preferably, the ratio between the downstream advance and the upstream advance is approximately to $\alpha$, $\alpha$ being the coefficient of elongation of the blank made by means of the mill.

The invention also relates to a device for controlling the advance of a tube blank on a cold rolling Pilger mill in which this advance is performed by means of a cam which makes a revolution while the roll stand makes a back and forth movement, this cam having two diametrically opposite bosses which act on the blank by a drive means, one of the bosses being set to act on the blank at the moment the roll stand is near the upstream dead center and the other boss being set to act on the blank at the moment the roll stand is near the downstream dead center. Preferably, the two bosses are of unequal thickness, the thinner boss being set to act on the rear of the blank near the upstream dead center of the roll stand.

A certain number of advantageous characteristics of the process and the device are also part of the invention.

The characteristics of the process according to the invention and those of a device for the use of this process will now be described in greater detail. Later a particular method for using the invention will be described.

It is well known that during a rolling pass, any blank undergoes, in the direction of the rolling, an elongation proportional to its thinning. In a Pilger mill of the type under consideration, the forward pass of the roll stand poses no problem. Near the upstream dead center of the stand, a pusher such as, for example, the one described in FR No. 1,602,013, or any other pusher of known type, causes the unit of the blank with an optimal length that is designated by "Δ" to advance. Then, during the forward pass of the stand, the blank is elongated itself by a length $(\alpha-1)\,\Delta L$, $\alpha$ being the coefficient of elongation. This coefficient $\alpha$ is defined as being the ratio of the length of the tube after rolling to the length of the blank before rolling. Thus, during the first rolling phase, which comprises the movement of the blank to the upstream dead center, then the forward pass of the roll stand, the rear of the blank is advanced by $\Delta L$, and the front is advanced by $\alpha\Delta$. The front part of the blank being free, its movement downstream poses no problem.

As regards the second rolling phase, which comprises the movement of the blank to the downstream dead center, then the return pass of the roll stand, it became evident that, to obtain an optimum efficiency from the mill, it was desirable to do approximately the same rolling work as during the first phase. This means that the blank must be elongated by about the same length $(\alpha-1)\Delta L$ during the return pass of the stand and the same amount of additional metal must be engaged in the grip of the rolls, which corresponds to the same actual advance $\Delta L$ from the rear of the blank during the second phase.

Now, during the return pass of the stand, the blank is elongated not downstream, but upstream. Also if it is desired to have an optimum rolling efficiency during the second rolling phase, it is necessary:

(a) to make possible an elongation of the blank of about $(\alpha-1)\Delta L$ during the return pass of the stand, the rear end of the blank should not strike against a pusher or any other obstacle that could block directly or indirectly its upstream movement, (b) to obtain, at the end of the second phase, an actual movement of the blank of about $\Delta L$ downstream in relation to the end of the first phase.

To obtain a maximum efficiency of the mill, the operating times $\Delta\theta_1$ and $\Delta\theta_2$ which are available near the upstream and downstream dead centers to advance and rotate the blank freely, have approximately the same period $\Delta\theta$. Also, the periods of the forward or return passes of the stand are approximately equal. The total period of the second rolling phase $\Delta t_2$, including the period $\Delta\theta_2$ of the operating time at the downstream dead center, is thus also equal to the total period $\Delta t_1$, including the operating period $\Delta\theta_1$ at the upstream dead center. It can be admitted that $\Delta t_1=\Delta t_2=\Delta t$. It appears from these observations that to have an optimum efficiency of the return rolling phase, it is necessary:

(a) during the operating time at the downstream dead center $\Delta\theta_2$, to make the blank rotate around its axis in a known way, for example, at the same angle as during the operating time at the upstream dead center and to make it advance by a length of about $\alpha\Delta L$, i.e., by a length $\Delta L$ equal to the advance made at the upstream dead center multiplied by the factor $\alpha$, (b) during the return pass of the roll stand, to allow the blank to be elongated upstream by a length of about $(\alpha-1)\,\Delta L$. Thus, at the end of the second phase, the rear of the blank is found to have actually advanced by a residual length of about $\Delta L$ approximately equal to its advance during the first rolling phase.

The invention also relates to a device for controlling the advance of the blank for using the process which was just been described. This device makes it possible to perform, under particularly favorable conditions, the periodic advance of the blank according to the laws which have been established. It has, in a known way, a pusher in the shape of a rocking lever, similar to a rocker arm, which is advantageously mounted on a carriage such as, for example, the one described in FR No. 1,602,013. This carriage supports the rear of the blank while advancing at a virtually constant speed in the direction of the roll stand. The rocking of the pusher is controlled by a cam which makes a rotation of one complete revolution while the roll stand makes a forward and return movement. The special feature of the device according to the invention consists in that the cam has two diametrically opposite bosses which each control a rocking movement of the pusher and, consequently, an advance movement of the blank. The cam is set so that the advance of the blank occurs when the roll stand is near each of the two upstream and downstream dead centers.

The thickness of the first boss is such that the corresponding rocking of the pusher transmits to the blank an optimum advance of $\Delta L$ near the upstream dead center, before the forward pass of the roll stand. This value $\Delta L$ is determined in a known way as a function of various parameters such as: quality of the metal, dimensions of the blank and of the tube to be made, characteristics of the grooves of the rollers and of the mandrel, etc.

Preferably, the second boss, diametrically opposite on the cam, has approximately the same thickness as the one which makes it possible for the pusher to transmit to the blank an advance approximately equal to $\alpha\Delta L$ near the downstream dead center, before the return pass of the roll stand. Taking into account the constant advance speed $\Delta L/\Delta t$ of the carriage and of the multiplying factor k of the lever shaped pusher, the thickness $e_1$ of the first boss is approximately $$k\,\Delta L\left(1-\frac{\Delta\theta}{\Delta t}\right)$$

and the thickness $e_2$ of the second boss about $$k\,\Delta L\left(\alpha - \frac{\Delta\theta}{\Delta t}\right).$$

BRIEF DESCRIPTION OF THE DRAWINGS

The description and the figures below offer, in a nonlimiting way, a particular method for using the invention.

DETAILED DESCRIPTION OF THE PREFERRED EMBODIMENTS

Figure 1:
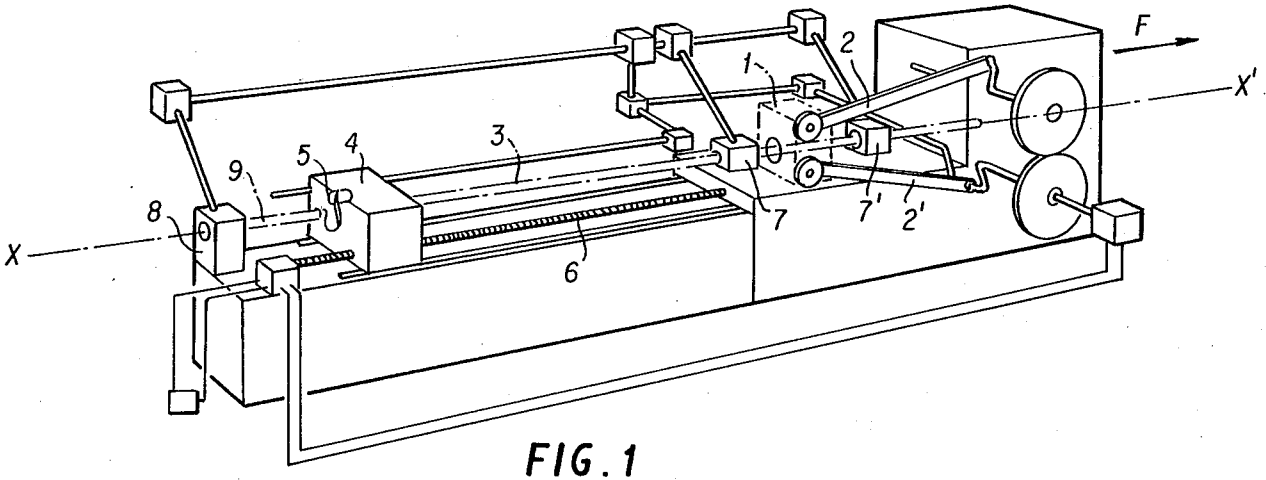
FIG. 1 shows, from a bird's-eye view, a cold rolling Pilger mill which makes possible the use of the process according to the invention.

FIG. 1 represents a cold rolling Pilger mill, with a design similar to the one which is, for example, described in FR No. 1,602,013. The roll stand (1) is drawn in chain dotted lines. The connecting rods (2—2') impart to it an alternating forward and return movement along the axis (XX') of the blank (3). A carriage (4) having a pusher (5) represented in greater detail in FIG. 2, supports the rear of the blank (3). This carriage is driven by a screw (6) which causes it to be moved continuously and regularly at the speed $\Delta L/\Delta t$ in the direction of the stand (1), i.e., in the direction of the arrow (F) that defines the upstream-downstream direction. Tube clamps (7—7') hold the blank (3) upstream and downstream from the carriage (1). As in the prior art, these tube clamps (7—7') periodically cause the blank to rotate around its axis (XX') by an angle of, for example, 60°, when the stand (1) arrives at one of its dead centers at the end of forward or return travel. The blank (3) slides in the clamps (7—7') when the pusher (5) causes it to advance in relation to the carriage (4).

A rod clamp (8) located at the rear of the mill holds an internal mandrel (9) and causes it to turn periodically in synchronism with the rotations of the blank (3). This mandrel does not undergo any axial movement.

Figure 2:
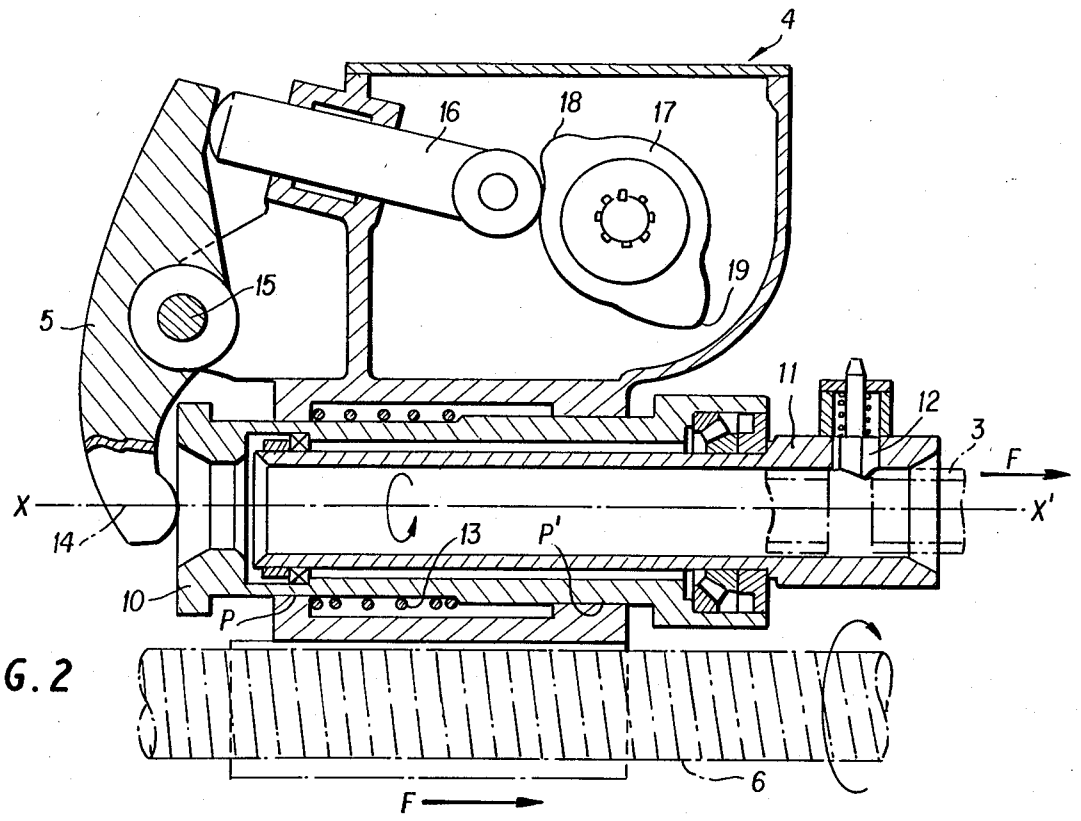
FIG. 2 shows, in section along its vertical plane of symmetry, a carriage which supports the rear of the blank and which is equipped with the device for controlling the advance of the blank according to the invention.

In FIG. 2, the section of the carriage (4) through the vertical plane that passes through the axis (XX') of the blank, makes it possible to see the details better. This carriage (4) supports the rear of the blank (3) by a sleeve (10) and a hollow rotating sleeve (11). The blank (3) is pushed by the rear by a spring stop (12) solid with the sleeve (11). As the figure shows, the sleeve (10) can be moved in relation to the carriage along the axis (XX') by sliding on journals (P—P'). A helical spring (13) is compressed when the sleeve (10) is moved upstream in relation to the carriage. The pusher (5) is articulated around a horizontal shaft (15) solid with the carriage (4). The lower part of the pusher (5) is divided into two symmetrical pins (14) of the cutting plane to allow the stationary internal mandrel (not shown here) to pass through the axis of the blank (3) and to make possible changes in the blank (3).

Thus the blank (3) is pushed forward by the combination on the one hand, of the continuous movement of the carriage (4) driven by the screw (6) at the constant speed, $\Delta L/\Delta t$ and, on the other hand, of the periodic thrust of the pins (14) of the pusher (5) which oscillates around the shaft (15). The pusher (5) is controlled by a rod (16) with rollers and a cam (17) acting against the sleeve (10).

Figure 3:
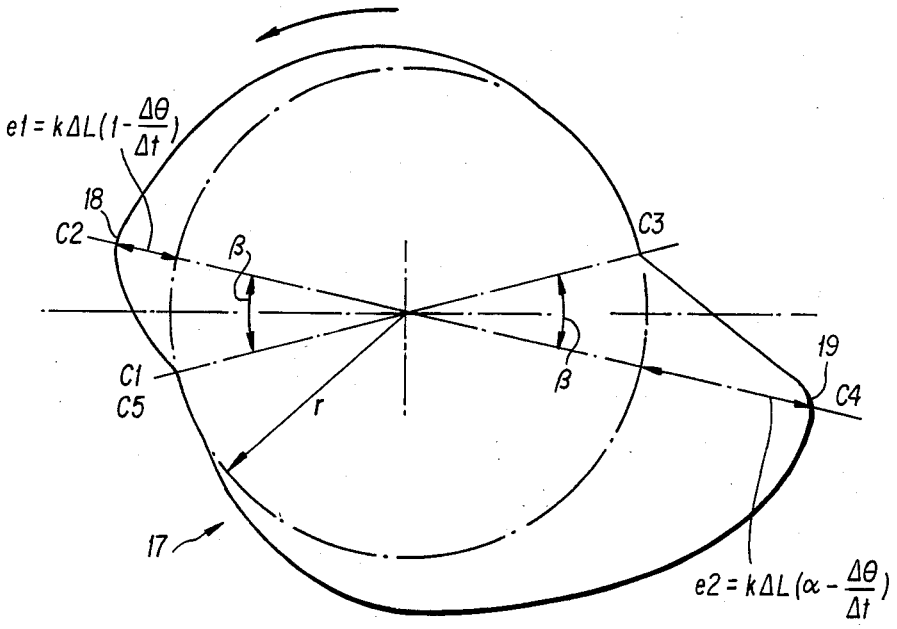
FIG. 3 shows in greater detail, in section, along the same plane, the cam according to the invention which controls the rocking of the pusher.

According to the invention, the cam (17) has two diametrically opposite bosses (18–19), as shown in FIG. 3. The thickness ($e_1$) of the boss (18) measured beyond the minimum radius (r) of the cam, is determined so that when this boss acts on the pusher (5) by the rod (16) with rollers, this pusher moves the blank (3) upstream by the sleeve (10) and the sleeve (11) by a length $\Delta L$ when the stand is near the upstream dead center. Also, and preferably, the thickness ($e_2$) of the boss (19) measured beyond this same radius (r), is determined so that by the pusher (5) this boss causes an advance of the blank by $\alpha\Delta L$, when the roll stand is near the downstream dead center.

More precisely, taking into account, on the one hand, the advance $$\Delta L\,\frac{\Delta\theta}{\Delta t}$$

of the carriage (4) during the upstream and downstream dead times, and, on the other hand, the "k" factor equal to the ratio of the lengths of the upper and lower arms of the pusher in relation to the shaft (15), the thickness ($e_1$) of the boss (18) is approximately $$k\,\Delta L\left(1 - \frac{\Delta\theta}{\Delta t}\right)$$

and the thickness ($e_2$) of the boss (19) is approximately $$k\,\Delta L\left(\alpha - \frac{\Delta\theta}{\Delta t}\right).$$

Figure 5:
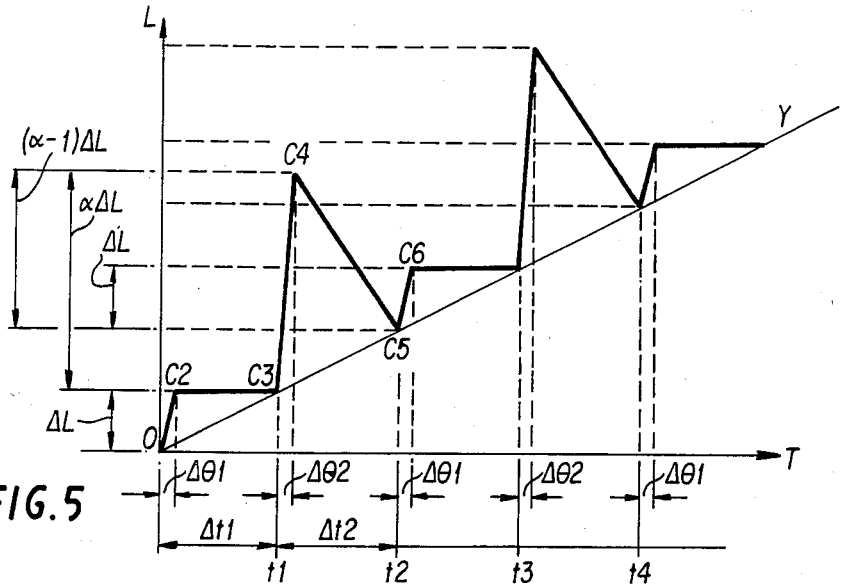
FIG. 5 is a diagram where the successive movements of the rear part of the blank are diagrammatically represented as ordinates as a function of time during the cycle described by FIGS. 4*a* to 4*c*.

The shape of the cam (17) corresponds approximately to the shape of the stepped curve (0 $C_2$ $C_3$ $C_4$ $C_5$ . . .) of FIG. 5, which shows the movement of the rear part of the blank as a function of time. The cam (17) can be plotted by giving to it for thickness of the bosses, the difference between the ordinates of the curve (0 $C_2$ $C_3$ $C_4$ $C_5$ . . .) and the ordinates of the straight line (OY) representing the movement of the carriage (4) along the axis (XX') at a constant speed $\Delta L/\Delta t$. Taking into account the inertia of the mechanical parts and to prevent jerking, the angular points of the curve (0 $C_2$ $C_3$ $C_4$ $C_5$ . . .) are obviously rounded on the cam (17).

To better understand the preferred method for using the process, there have been represented diagrammatically and ignoring scale, in FIGS. 4*a*, 4*b*, 4*c*, 4*d*, 4*e*, in section, the successive positions of the blank (3) in relation to the mandrel (9), before and after each of the two phases of a complete rolling cycle with a forward and return movement of the stand (1).

As is well known by experts, the mandrel (9) is rotated around the axis (XX') during the operating time at the dead center $\Delta\theta$, before each forward or return rolling pass, this at the same time as the blank, but is never moved along the axis (XX').

Like mandrels of the prior art, this mandrel has a cylindrical rear part and a forward part which tapers in a shape known itself to best take the deformation of the blank (3) during a rolling pass.

The plane at right angles in relation to the axis XX', along which the cylindrical part and the tapered front part of the mandrel (9) is connected is referred to here as (AA').

For the clarity of the description, a stationary orthogonal plane more to the rear has been referred to by (BB'). A reference (C) has also been shown on the rear of the blank (3) which advances step by step between each rolling pass, both forward and return. This reference (C) successively occupies the positions ($C_1$, $C_2$, $C_3$, $C_4$, $C_5$ . . .) in relation to the plane (BB'). These references ($C_1$, $C_2$, $C_3$, $C_4$, $C_5$ . . .) have also been plotted on the corresponding points of the diagram of FIG. 5 and on the cam in FIG. 3.

In FIG. 5, the starting point (0) of the curves corresponds to the point ($C_1$). A reference (D) has been shown on the part already rolled of the blank directly above the end (20) of the mandrel (9).

Figure 4A:
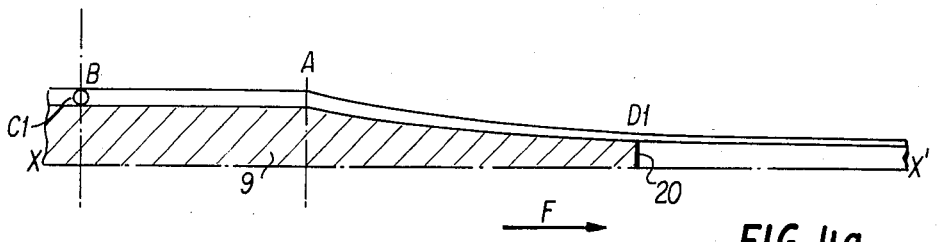
FIGS. 4*a*, 4*b*, 4*c*, 4*d*, 4*e* each diagrammatically represent an axial semi-section of the blank at the beginning and at the end of each of the two consecutive rolling phases, forward and return, corresponding to a complete forward-return rolling cycle of the roll stand in the process according to the invention.

At the end of a complete operation of rolling by forward-return movement of the stand (1), the blank (3) is pressed against the mandrel (9) by the final return phase as shown in FIG. 4*a*. The reference ($C_1$) is in the plane referenced (BB').

To make rolling work possible during the next rolling cycle and, more particularly, during the next forward phase of the stand (1), the blank (3) is advanced by the carriage (4) and the pusher (5) by a length $\Delta L$, during the time available at the upstream dead center $\Delta\theta_1$ of the roll stand (1). The reference ($C_1$) comes to ($C_2$) at a distance $\Delta L$ downstream from the plane (BB') as shown in FIG. 4*b*.

Figure 4B:
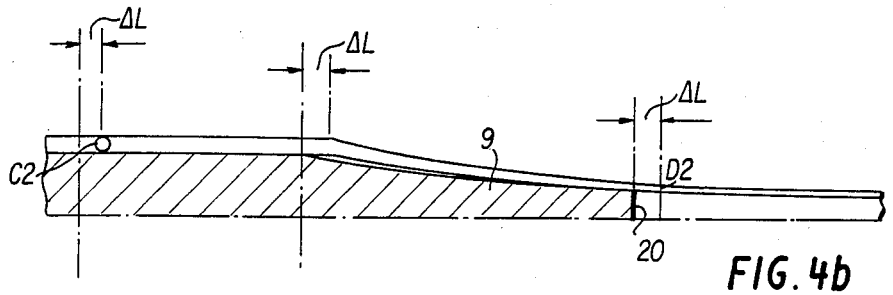

The blank (3) is detached from the mandrel (9) as is particularly apparent in the vicinity of the plane (AA') in FIG. 4*b*. The point (D) of the rolled part which was at ($D_1$) directly perpendicular to the front end (20) of the blank (3) was advanced by $\Delta L$ at ($D_2$), as shown in FIG. 4*b*.

Figure 4C:
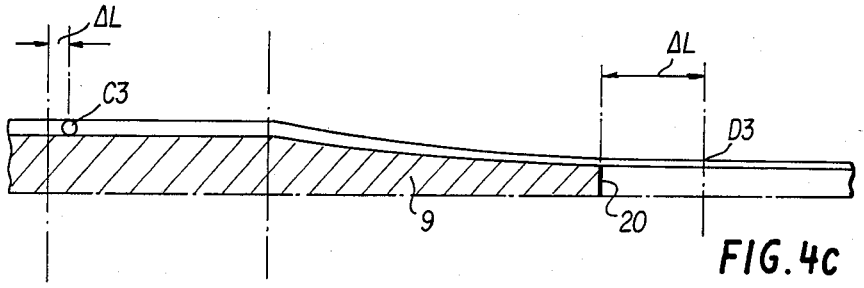

The forward pass, which is in the direction (F) from the stand (1), thus thins the blank by elongating it and flattening it against the mandrel (9), as shown in FIG. 4*c*. The reference (C) remained at ($C_3$) at the same distance $\Delta L$ from the plane (BB'). The point (D) of the blank (3) was advanced at ($D_3$) to a distance $\alpha\Delta L$ from the front end (20) of the mandrel (9).

Figure 4D:
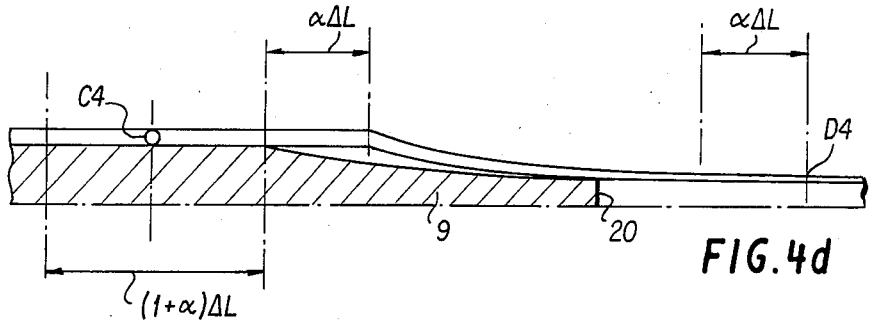
Figure 4E:
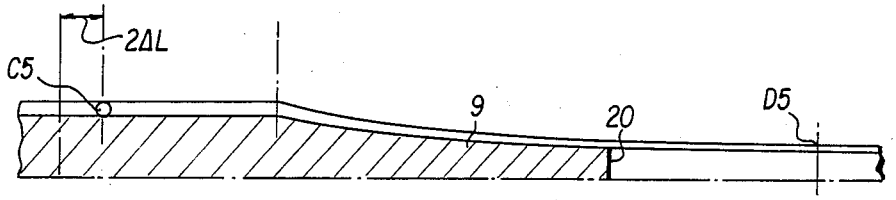

While the stand (1) is at the downstream dead center, under the action of the carriage (4) and the pusher (5), the blank (3) is again advanced, but this time, not by a length $\Delta L$, but by about $\alpha\Delta L$, as shown in FIG. 4*d* where the reference (C) comes to ($C_4$) at a distance of about $\alpha\Delta L$ downstream from its prior position ($C_3$), i.e., at a distance of about $(1+\alpha)\ \Delta L$ from the plane (BB'). The reference (D) is simultaneously advanced beyond its previous position ($D_3$) from the same distance of about $\alpha\Delta L$. Thus, it is at ($D_4$) at a distance of about $2\alpha\Delta L$ from said end (20). During the return pass of the stand, the blank is flattened against the mandrel (9). The front end of the blank is not moved, as is shown by the reference ($D_5$) which is not moved in relation to ($D_4$). The metal of the blank is, however, driven backward and the reference (C) comes to ($C_5$) at a distance $2\Delta L$ downstream from the plane (BB'), as shown in FIG. 4*e*. A new forward-return rolling cycle which will begin by a new advance of the rear of the blank (shown by point C) by a new length $\Delta L$ can thus be started again.

The backward movement of the blank (3) during the return pass of the stand (1) is made possible by the control of the pusher (5) by the descending part ($C_4$ $C_5$) of the boss (19) of the cam (17). The shape of the descending part ($C_4$ $C_5$) of this boss (19) corresponds to a backward movement of the pins (14) of the pusher (5) which make possible the backward movement of the sleeve (10) and the sleeve (11) pushed by the rear end of the blank.

The shape of the cam (17) is easily deduced from the diagram of FIG. 5 where, the time is plotted on the x-axis (0T), the advance of the rear of the blank on the y-axis (0L) shown by reference C. The continuous advance of the carriage (4) along the axis (XX') is shown by the straight line (0Y). The slope of this straight line is $\Delta L/\Delta t$.

The intervals of equal times "t" taken to perform each forward or return rolling phase are shown by the references ($t_1$, $t_2$, $t_3$, $t_4$) on the time axis. The actual advances performed by the rear of the blank (or point C) during each phase are shown by the ordinates of the curve (0 $C_2$ $C_3$ $C_4$ $C_5$). The point ($C_1$) is merged with the origin (0). This curve is then repeated. On the time axis, there are noted the intervals $\Delta\theta_1$ and $\Delta\theta_2$ corresponding to the period of the operating times available at the upstream and downstream dead centers of the movement of the stand (1). It is during these time intervals $\Delta\theta=\Delta\theta_1=\Delta\theta_2$ that the blank (3) is released from the grip of the rolls and can be advanced under the combined action of the advance of the carriage (4) and of the pins (14) of the pusher (5).

Figure 6:
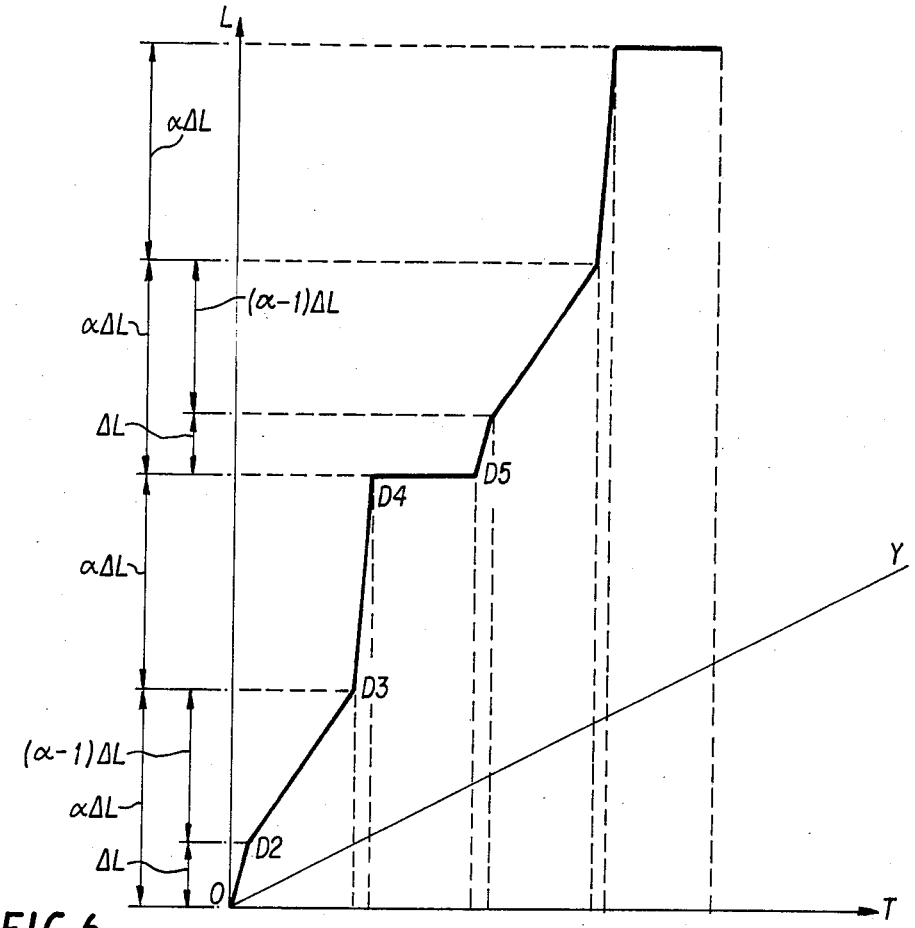
FIG. 6 is a diagram where, on the same scale, the successive movements of the forward part of the blank during the cycle described in FIGS. 4*a* to 4*c* are diagrammatically represented as ordinates.

Also, FIG. 6 shows the movements of the front part of the blank as a function of time. The scales used are the same as in FIG. 5. The point ($D_1$) is merged with the origin 0. The points ($D_2$, $D_3$, $D_4$ and $D_5$) correspond to the same moments as the points ($C_2$, $C_3$, $C_4$, $C_5$) of FIG. 5. It is seen that, during a complete cycle, the front (D) advances by 2 $\alpha\Delta L$, while the rear (C) advances by $2\Delta L$.

During the first dead time $\Delta\theta_1$, the rear of the blank (C) and the front (D) advance simultaneously by a length $\Delta L$ from ($C_1$) to ($C_2$) and from ($D_1$) to ($D_2$). This advance results, on the one hand, from a movement $$\Delta L\,\frac{\Delta\theta}{\Delta t}$$

because of the advance of the carriage (4) as a whole and, on the other hand, from a movement $$\Delta L\left(1-\frac{\Delta\theta}{\Delta t}\right)$$

under the thrust of the pins (14) of the pusher (5) activated by the rising part ($C_1C_2$) of the boss (18) of the cam (17).

During the forward rolling pass, the point (C) remains approximately immobile at ($C_2$), because the pins (14) of the pusher (5) exert no pressure on the sleeve (10). Actually, the advance $$\Delta L\left(1-\frac{\Delta\theta}{\Delta t}\right)$$

of the carriage (4) is compensated by the backward movement of the pins (14) corresponding to the descending part ($C_2$ $C_3$) of the boss (18). Simultaneously, the point (D) advances from ($D_2$ to $D_3$) by a length $(\alpha-1)\Delta$.

During the second dead time $\Delta\theta_2$, the front, like the rear, of the blank (3) advances about $\alpha\Delta L$. The references (C) and (D) come to ($C_4$) and ($D_4$) respectively. This advance is the resultant, on the one hand, of the advance of the carriage (4) by $$\Delta L\frac{\Delta\theta}{\Delta t}$$

and, on the other hand, of the advance by about $$\Delta L\left(\alpha-\frac{\Delta\theta}{\Delta t}\right)$$

of the pins (14) activated by the rising part $C_3$ $C_4$ of the boss (19).

The rising parts of the bosses (18–19) correspond to the same angle $$\beta=\pi\frac{\Delta\theta}{\Delta t}.$$

During the return pass, the front of the blank (D) remains immobile at ($D_5$) while the rear moves backward by about $(\alpha-1)$ $\Delta L$, point C being moved from $C_4$ to $C_5$.

The backward movement of the rear (C) of the blank (3) is made possible because, at the advance of the carriage (4) by $$\Delta L\left(1-\frac{\Delta\theta}{\Delta t}\right),$$

it opposes a greater backward movement equal to $$\Delta L\left(\alpha-\frac{\Delta\theta}{\Delta t}\right)$$

of the pins (14) of the pusher (5) activated by the descending part ($C_4$ $C_5$) of the boss (19) of the cam (17).

Tests have shown that, depending on the types of grooves and mandrels used, a slight backward movement of the rear part of the blank can be observed during the forward rolling pass. This backward movement depends, in particular, on the position of the neutral radius of the roll in relation to the depth of the groove. The neutral radius is the radius of the circle for which the peripheral speed is equal to and opposed to the translation speed of the stand. It is easily understood that, when the tube comes in contact with the groove in its deepest area, i.e., with a radius less than the neutral radius, the roll has a tendency to drive the metal in the direction of the movement of the stand, because the peripheral speed at the base of the groove is less than the translation speed in the direction of the movement.

On the other hand, at the end of the groove, in the shallowest area of the groove, the peripheral speed at the base of the groove is greater than the translation speed and the roll has, on the other hand, a tendency to drive the metal in a direction opposite that of the direction of the movement of the stand.

A very important advantage of the process and the device according to the invention is that they make it possible to give to the bosses of the cam the desired shape to accompany the relative movement of the rear of the blank in relation to the carriage during the rolling passes.

It is generally not necessary that the shape of the cam in the descending area ($C_2$–$C_3$) be such that the pins (14) in their backward movement remain in contact with the rear part of the sleeve (10) solid with the blank (3) in its relative upstream movement in relation to the carriage (14). This means that the slope of descent of the cam shape beyond the top of the boss (18) can be, if desired, much steeper than the minimum slope which provides the backward movement of the pins (14) with a speed at each moment equal to the relative speed of backward movement of the rear of the blank (3) in relation to the carriage (4).

On the other hand, during the return rolling pass it is very important to control the backward movement of the blank thanks to a suitable shape of the cam in the descending area ($C_4$–$C_5$) beyond the top of the boss (19).

Actually, because of the advance $\alpha\Delta L$ of the blank which has been made at the site of the downstream dead center, the blank is released from the tapered part of the mandrel over a significant length and risks sliding upstream by escaping partly the grip of the grooves of the rolls during the return pass of the roll stand. The cam shape in the area ($C_4$–$C_5$) must therefore be studied to make the backward movement possible without sliding of the blank in relation to the carriage. This speed of backward movement without sliding of the blank during the return rolling phase depends on numerous factors such as the physical characteristics of the metal to be rolled, the section of the blank, the coefficient of elongation "$\alpha$" which is imposed on it, the shape of the mandrel in the rolling area, and the corresponding shape of the grooves of the rolls.

In practice, particular attention is paid, in general, to giving to the cam in the area ($C_4$–$C_5$) such a shape that the speed of backward movement of the pins (14) is approximately equal at each moment to the speed of backward movement of the blank without sliding.

To prevent the risks of breaking the pusher or the cam, it is useful to provide a force limiting means such as a calibrated spring which can be inserted at a suitable point of the mechanical drive between the rear of the blank and the cam. The device can also be housed at the site of the drive means of the cam-holding carriage.

It is possible to place between the cam (17) and the pusher (5) not a rod (16) with rollers rolling directly on the cam, but a drive means having an amplitude control that makes it possible to modify the factor "k" of drive to the pins (14) of the movements caused by the bosses (18) and (19). For example, a connection between cam (17) and pusher (5) made by a lever exhibiting at least an adjustable arm such as the one described in FR No. 2,379,326 can be used. As a result of this device, the advance can be modified as a function of the characteristics of deformability of the metals or alloys to be transformed, "$\alpha$" remaining constant for a given cam.

It is also possible to consider placing the cam and the pusher not on a mobile carriage, but in a stationary position, the pusher (5) then driving the blank (3) by a direct drive.

Also, instead of a single cam, two synchronized cams can be used, one having the boss (18) and the other, the boss (19). These two cams can each directly or indirectly activate a pusher whose pins rest against the rear of the blank, generally by a sleeve.

Tests have shown that the process and the device according to the invention make it possible to increase remarkably the productivity of the Pilger cold rolling mills as a result of the balanced distribution of the rolling work over the entire operating cycle without modifying the operating rate of the roll stand. Moreover, taking into account the high operating rates of the stand, it is particularly advantageous to mount the advance device on a mobile carriage such as the one described in FIGS. 1 and 2. The changes of advance can be performed easily by cam changing or further by using a drive having an amplitude control.

This arrangement makes it possible to reduce the weight of the masses in movement, to shorten the mechanical drives and to reduce the clearances for the advance of the blank in relation to an arrangement according to which the cam system is mounted at a stationary post. In any case, the modifications of advance can be easily made by changing a cam or further by using a drive having an amplitude control.

The nonlimiting example describes below, in a nonlimiting way, a method for using the device and the process according to the invention.

A Pilger mill for cold rolling capable of blanks with outside diameters between 70 and 140 mm, provided with work rolls 500 mm in diameter working at the rate of 120 forward-return cycles per minute.

A tube blank with an outside diameter of 80 mm and 8 mm thick is used.

This mill is provided with a system for advancement by a pusher controlled by a cam which makes a revolution while the roll stand makes a forward-return movement. Given the characteristics of the mill and of the metal of the blank, there are chosen as operating parameters and advance of the blank $\Delta L$ of 10 mm and a coefficient of elongation of 4.

This mill is first used in a conventional manner, the cam having a single boss and thus a single advance $\Delta L$ is made per cycle at the upstream dead center.

Therefore, the blank advances about 1.2 m/min and 4.8 m/min of rolled tube is obtained. Then the cam with a single boss is replaced with a cam according to the invention having two bosses whose thickness ratios and shapes are determined according to the invention, so as to make possible an advance of the blank equal to $\alpha\Delta L$ at the upstream dead center and equal to $\alpha\Delta L$ at the downstream dead center. It is found, under these conditions, that by operating with the same rate of 120 cycles per minute, the blank advances about 2.4 m/min and 9.6 m/min of rolled tube are obtained. Therefore, the invention makes it possible to double the production without modifying the operating rate of the roll stand.

Numerous variants of the process or the device according to the invention can be developed which do not go outside the scope covered by the claims.

What is claimed is:

1. A process for cold rolling of tubes utilizing a Pilger mill, a roll stand and a blank, which comprises:
   - driving said roll stand with a forward and return cyclical movement;
   - advancing the blank near each of upstream and downstream dead centers thereof; and
   - rolling said blank during a return pass of said roll stand wherein a rear part of said blank is moved backwards during rolling performed during said return pass of said roll stand.

2. A process as claimed in claim 1, which further comprises maintaining a ratio between the downstream advance and the upstream advance of said blank is approximately equal to $\alpha$ wherein $\alpha$ is the coefficient of elongation of said blank.

3. A process as claimed in claim 1, which further comprises limiting the backward movement of the rear part of said blank in relation to a stationary reference point so as to be approximately equal to an actual advance at said upstream dead center multiplied by ($\alpha$1 1).

4. A process as claimed in claim 1, which further comprises controlling the backward movement of the rear part of said blank.

5. A device for cold rolling of tubes, comprising:
   - a Pilger mill having a roll stand;
   - means connected to said roll stand for driving said roll stand under a forward and return cyclical movement, said forward and return cyclical movement having respective upstream and downstream dead centers;
   - means located on said mill for controlling the advance of a tube blank near the upstream and downstream dead centers, said means for controlling being operatively connected to said means for driving and having cam means whereby said cam means makes one revolution during the forward and return movement of said roll stand; and
   - drive means associated with said means for controlling, said cam means having first and second diametrically opposite bosses for acting on said blank through said drive means, said first boss acting on said blank when said roll stand is near the upstream dead center and said second boss acting on said blank when said roll stand is near the downstream dead center.

6. A device as claimed in claim 5, wherein said first and second bosses of said cam means are of unequal thickness, said first boss having a smaller thickness for acting on said tube blank near the upstream dead center of said roll stand.

7. A device as claimed in claims 5 or 6, wherein said cam means is fixed with respect to a carriage which is movable at a constant speed downstream during rolling.

8. A device as claimed in claim 7, further comprising force limiting means inserted at a side of a mechanical drive of said carriage.

9. A device as claimed in claims 5 or 6, wherein said drive means further comprises a pusher wherein said cam means acts on said tube blank by said pusher.

10. A device as claimed in claim 9, further comprising transmission means placed between said cam means and said pusher.

11. A device as claimed in claim 10, wherein one of said pusher and said transmission means includes an amplitude control.

12. A device as claimed in claim 6, wherein a ratio between the thicknesses of said first and second bosses is close to the value of $\alpha$ wherein $\alpha$ is the coefficient of elongation of said tube blank.

13. A device as claimed in claim 12, wherein the thickness of said first boss is approximately equal to $$K\,\Delta L\left(1-\frac{\Delta\theta}{\Delta t}\right)$$

and wherein the thickness of said second boss is approximately equal to $$k\,\Delta L\left(\alpha-\frac{\Delta\theta}{\Delta t}\right).$$

14. A device as claimed in claim 5, further comprising force limiting means inserted at a sight of a mechanical drive between the rear of the tube blank and the cam means.

15. A device as claimed in claim 14, wherein said force limiting means further comprises a calibrated spring.

* * * * *